United States Patent [19]

DiEgidio

[11] Patent Number: 4,709,926

[45] Date of Patent: Dec. 1, 1987

[54] ELECTORAL COLLEGE GAME

[76] Inventor: Leo C. DiEgidio, 10512 Northfield Rd., Northfield, Ohio 44067

[21] Appl. No.: 867,418

[22] Filed: May 15, 1986

Related U.S. Application Data

[63] Continuation of Ser. No. 544,097, Oct. 21, 1983, abandoned.

[51] Int. Cl.[4] ..... A63F 3/00

[52] U.S. Cl. ..... 273/257

[58] Field of Search ..... 273/256, 257, 279, 249

[56] References Cited

U.S. PATENT DOCUMENTS

| | | | |
|---|---|---|---|
| 2,043,482 | 6/1936 | Lord | 273/257 |
| 2,484,051 | 10/1949 | Robbins | 273/256 |
| 3,109,652 | 11/1963 | Strand et al. | 273/256 |
| 3,318,601 | 5/1967 | MacLeod . | |
| 3,368,816 | 2/1968 | Milazzo et al. . | |
| 3,545,762 | 12/1970 | Atkinson | 273/257 |
| 3,907,299 | 9/1975 | Kristen . | |
| 4,092,028 | 0/1978 | Marse | 273/257 |
| 4,118,036 | 10/1978 | Marse | 273/257 |
| 4,216,967 | 8/1980 | Marse | 273/257 |
| 4,299,390 | 11/1981 | Delgado | 273/257 |

*Primary Examiner*—Richard C. Pinkham
*Assistant Examiner*—Matthew L. Schneider
*Attorney, Agent, or Firm*—Wayne D. Porter, Jr.

[57] ABSTRACT

A political campaign game is disclosed herein which is particularly adapted to simulate the conditions of an actual presidential campaign and includes a game board having playing zones which include a first group of popular vote obtaining zones and a second group of political occurrence zones. Each zone of the first group has the name of various voting areas selected from the fifty states and the District of Columbia. Some of the zones within the first group contain the name of a voting area that is also contained in other zones within the first group. The second group of zones instruct the player to draw either a political deal, speech or event card. A player score means having a score registering means is also included to accurately record the total number of popular votes received in each state.

8 Claims, 9 Drawing Figures

FIG. 1

"ANY COUNTRY THAT DISAGREES WITH AMERICA SHOULD BE BOMBED INTO THE STONE AGE."

THE ELECTORATE THINKS YOU ARE TOO PRIMITIVE.

MOVE BACK
NEW JERSEY
SOUTH DAKOTA
OREGON
RHODE ISLAND
WEST VIRGINIA

22

FIG.5

THE PRESIDENT OF SWITZERLAND SAYS YOUR BANK ACCOUNT IS OVERDRAWN.

MOVE BACK
COLORADO
GEORGIA
MARYLAND
MISSOURI
NEW JERSEY

24

FIG.6

USE THE CAVALRY TO DISPERSE A DEMONSTRATION OF UNEMPLOYED VETERANS.

| MOVE FORWARD | MOVE BACK |
|---|---|
| IDAHO | CALIFORNIA |
| MONTANA | COLORADO |
| NEVADA | DELAWARE |
| NEW MEXICO | MARYLAND |
| OKLAHOMA | MASSACHUSETTS |
| UTAH | NEW YORK |
| WYOMING | PENNSYLVANIA |
| | VIRGINIA |
| | DIST. OF COLUMBIA |

20

FIG.7

FIG.8

OHIO

CAPITAL: COLUMBUS
STATE BIRD: CARDINAL
STATE TREE: BUCKEYE
AREA: 41,222 SQ. MI.
POPULATION: 10,772,342

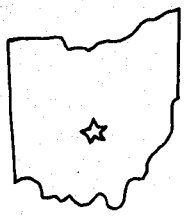

| | |
|---|---|
| CONGRESSMEN | 21 |
| SENATORS | 2 |
| ELECTORS | 23 |

44

FIG.9

44

OHIO
"THE BUCKEYE STATE"

ELECTORAL COLLEGE GAME

This application is a continuation of application Ser. No. 544,097, filed on Oct. 21, 1983 and now abandoned.

BACKGROUND OF THE INVENTION

1. Field of the Invention

This invention relates to games and, more particularly, to a political election game in which the players seek to achieve the office of the President of the United States by obtaining a majority of electoral college votes.

2. Description of the Prior Art

Election type games having a playing board with a number of spaces disposed about the periphery thereof have generally been known for many years. Typically, these games include playing pieces which are moved through a path of spaces in an attempt by a particular player to obtain a requisite number of popular votes to achieve a particular elective office. The player operates a spinner, dice or other chance means to determine the number of spaces which can be moved in a particular turn. After a requisite number of turns, or the requisite number of votes are obtained, play is ended. Representative of the above-described well-known games are those described in U.S. Pat. Nos. 4,299,390; 3,368,816; and 3,318,601.

All such games contain some distinctive feature in the rules of play to distinguish one from the other. Typically, each game provides a different means by which players can accumulate popular or electoral college votes. However, such games are based on chance rather than the player's own sense of politics and, hence, do not parallel the events and occurrences which may happen in an actual election campaign. No game effectively allows the player to determine his own political strategy during the play of the game.

SUMMARY OF THE INVENTION

Accordingly, it is a primary objective of the present invention to provide a novel election game which allows players to develop and utilize a political strategy to obtain a maximum number of electoral college votes in the shortest period of time.

Another object of the present invention is to reflect and closely approximate the conditions of an actual presidential election in providing occurrences and events which can be both planned and unexpected.

A further object of the present invention is to provide a teaching aid to teach the players how the electoral college vote system works.

In accordance with an aspect of the present invention a political campaign game particularly adapted to simulate the conditions of an actual presidential election campaign in the United States is herewith disclosed and includes a game board having a plurality of playing zones disposed about the periphery thereof and which are in a continuous path. Indicia are printed on the game board and the playing zones thereby defining a first group of popular vote obtaining zones and a second group of political occurrence zones. The first group contains indicia which determines the group of states in which a particular player has gained popular votes by landing in this zone. The second group includes indicia instructing either political deals, political speeches or political events which approximate actual conditions of a presidential election and which inherently provide the players with an opportunity to exercise political strategy and tactics. A starting position and an open campaign position are also denoted in the playing zones.

BRIEF DESCRIPTION OF THE DRAWINGS

The foregoing and other objects, advantages and characterizing features of the present invention will become clearly apparent from the ensuing detailed description of an illustrative embodiment thereof, taken together with the accompanying drawings wherein like reference numerals denote like parts throughout the various views and in which:

FIG. 5 is a top view of a stack of political speech cards, the top card shown in detail;

FIG. 6 is a top view of a stack of political event cards, the top card shown in detail;

FIG. 7 is a top view of a stack of political deal cards, the top card shown in detail;

FIG. 8 is a top view of a stack of state cards the front of the top card shown in detail; and FIG. 9 is a top view of a stack of state cards the back of the top card shown in detail.

DESCRIPTION OF THE PREFERRED EMBODIMENT

Figure 1:
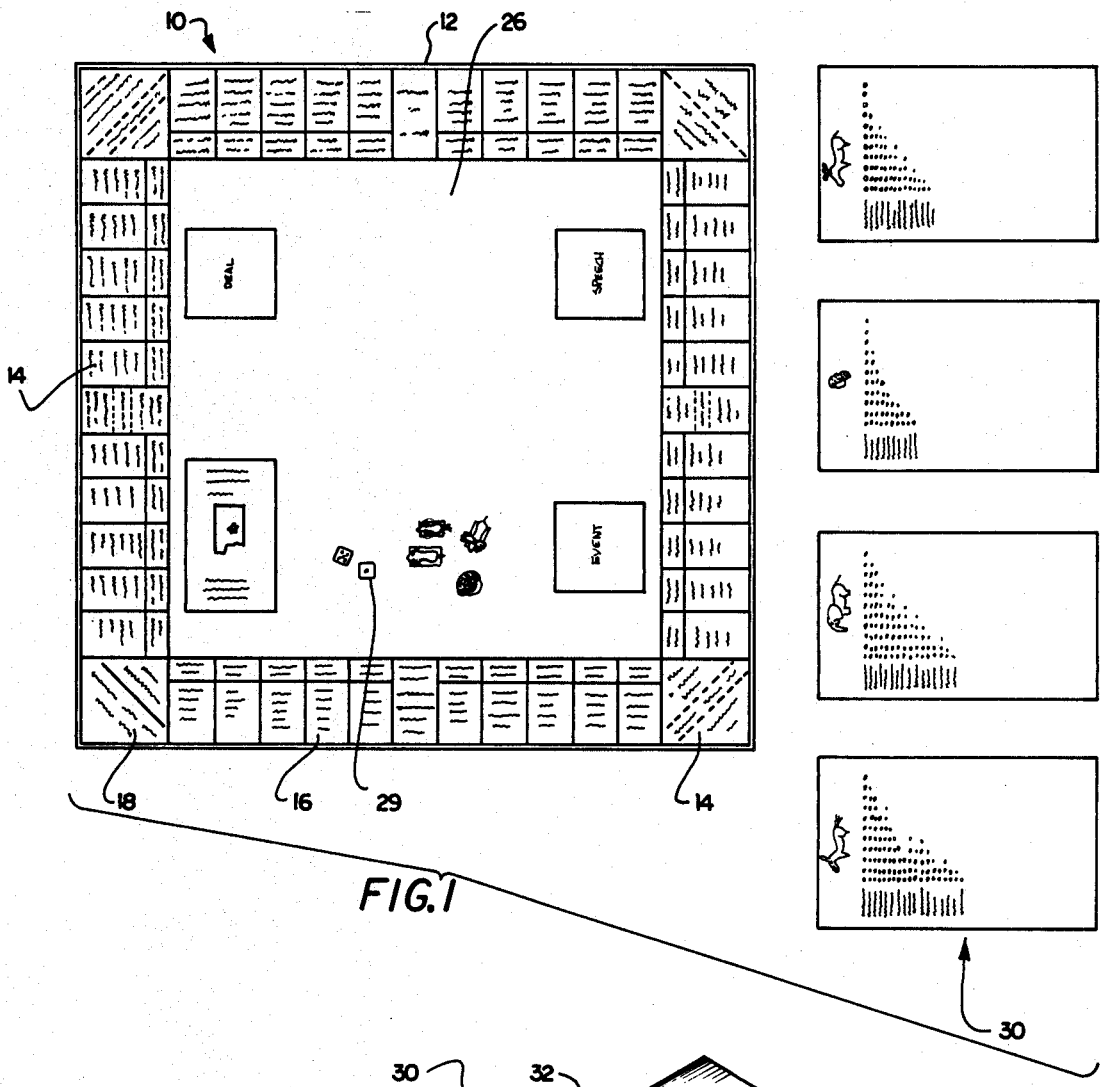
FIG. 1 is a top plan view of the game board and the player scoring means.

Referring now in detail to FIGS. 1 through 4, there is shown an electoral college game according to the teachings of the present invention with the game 10 including a game board 12 having a play surface made of any suitable material, and having a plurality of playing zones 14 disposed about the periphery thereof. Typically, the board 12 is divided into a total of 48 playing zones. The playing zones 14 include a first group of popular vote obtaining zones 16, and a second group of political occurrence zones 18, and which describe political occurrences such as political speeches, deals or events which happen either at the player's option or immediately as is explained in the rules of play as set out hereinbelow. Upon the player landing on a political occurrence zone 18 the player is instructed to select either a political deal card 20, political speech card 22 or political event card 24. These cards have indicia thereon which affect the percentage of the popular vote gained or lost by the player in each state listed on the particular card, as is more fully described below. The cards are typically placed in the central portion 26 of the board 12 during the play of the game as is shown in FIG. 1. The cards can, of course, be made of any suitable material.

The player pieces 28 are provided to designate a particular player or political party. Player pieces 28 are moved along the playing zones 14 in an effort to obtain popular votes in the states in an attempt to gain more than 50% of the popular votes in a given state thereby obtaining the total electoral college votes of the particular state. If a player obtains more than 270 electoral college votes that player has won the game. Chance means 29, preferably a set of dice, are provided to indicate the number of player zones 14 a player will move in a particular turn. Any other type of chance means, such as a spinner, can also be provided and is contemplated to be within the scope of the present invention.

Figure 2:
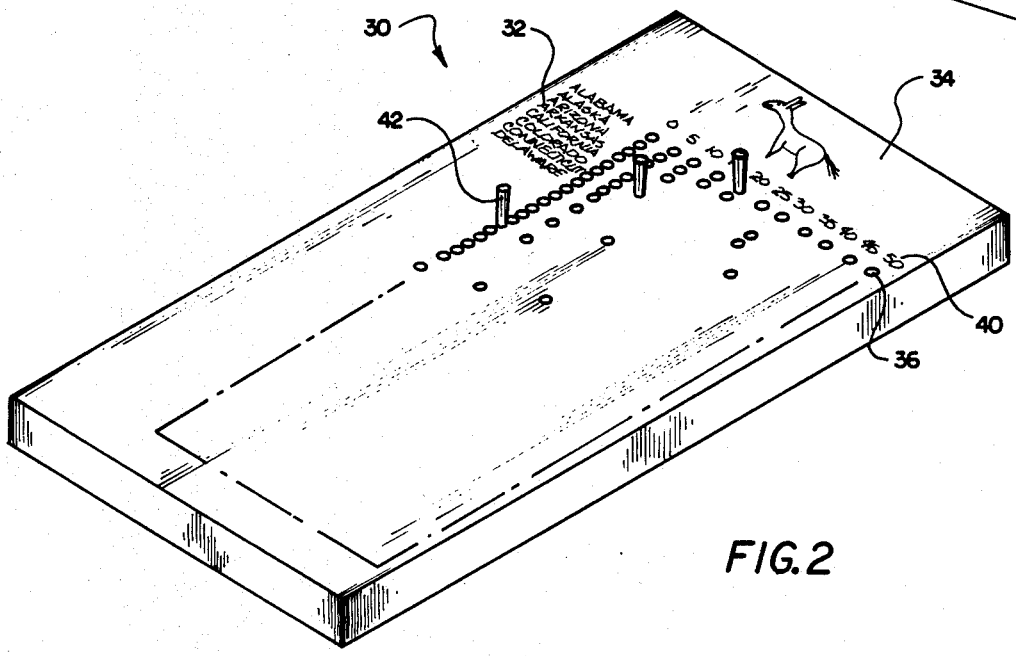
FIG. 2 is a perspective view of a player scoring means in detail showing the indicia, peg holes and score registering means positioned thereon.

A player scoring means 30 is also provided to each player for accurate recording of the percentage of popular votes received in each state. As shown in FIG. 2, the states 32 are alphabetically listed in a column arrangement along one side of the scoring surface 34. A plurality of holes 36 are also provided in a column arrangement and are in spaced relation to the states 32. Above each column of holes 36 is provided indicia 40 to correlate the percentage of popular votes received to the particular column of holes. Normally each hole to the right of the states 32 indicates a 5% increase in popular votes received. Pegs 42, or score registering means, are provided to serve as markers which can be manually inserted into the appropriate hole 36 to indicate actual votes received. It should also be realized that other score registering means are contemplated to be within the scope of the present invention. Particularly, a player scoring means 30, such as a box as shown in FIG. 2, can include an electrical score registering means which may include a row of small lights aligned in columns rather than pegs and pegholes. These lights, by illumination, could be used to indicate the amount of popular votes received in a particular state. Further, the scoring means 30 could also include a self-contained power unit, i.e. a battery, for providing the necessary electrical power for an electrical score registering means as described hereinabove.

State cards 44 are also provided, as shown in FIGS. 8 and 9, for indicating geographical, historical and total electoral college vote information pertaining to the particular state.

Rules of Play

The political campaign game of the present invention may be played by at least two and up to four players. The object of the game is for one of the players to be elected President of the United States by accumulating the States by accumulating the maximum number of electoral college votes by means of acquiring popular votes through making political speeches or deals and by landing on popular vote obtaining zones during the play of the game.

Initially, a player selects a play piece 28 with which he will be identified with during the entire game. The selected pieces are moved along playing zones 14 in accordance with the numbers rolled on the chance means or dice 29. Play begins with the player who throws the highest number on the dice and proceeds from player to player in a clockwise direction.

Each player, starting with the first player, rolls the dice 29 and moves his marker 28 around the board from a start space which can be any square designated on the board 12. Normally, it is specified that the square "open campaign" is also the start square. No votes are given to any player when he starts or lands on this square.

Figure 3:
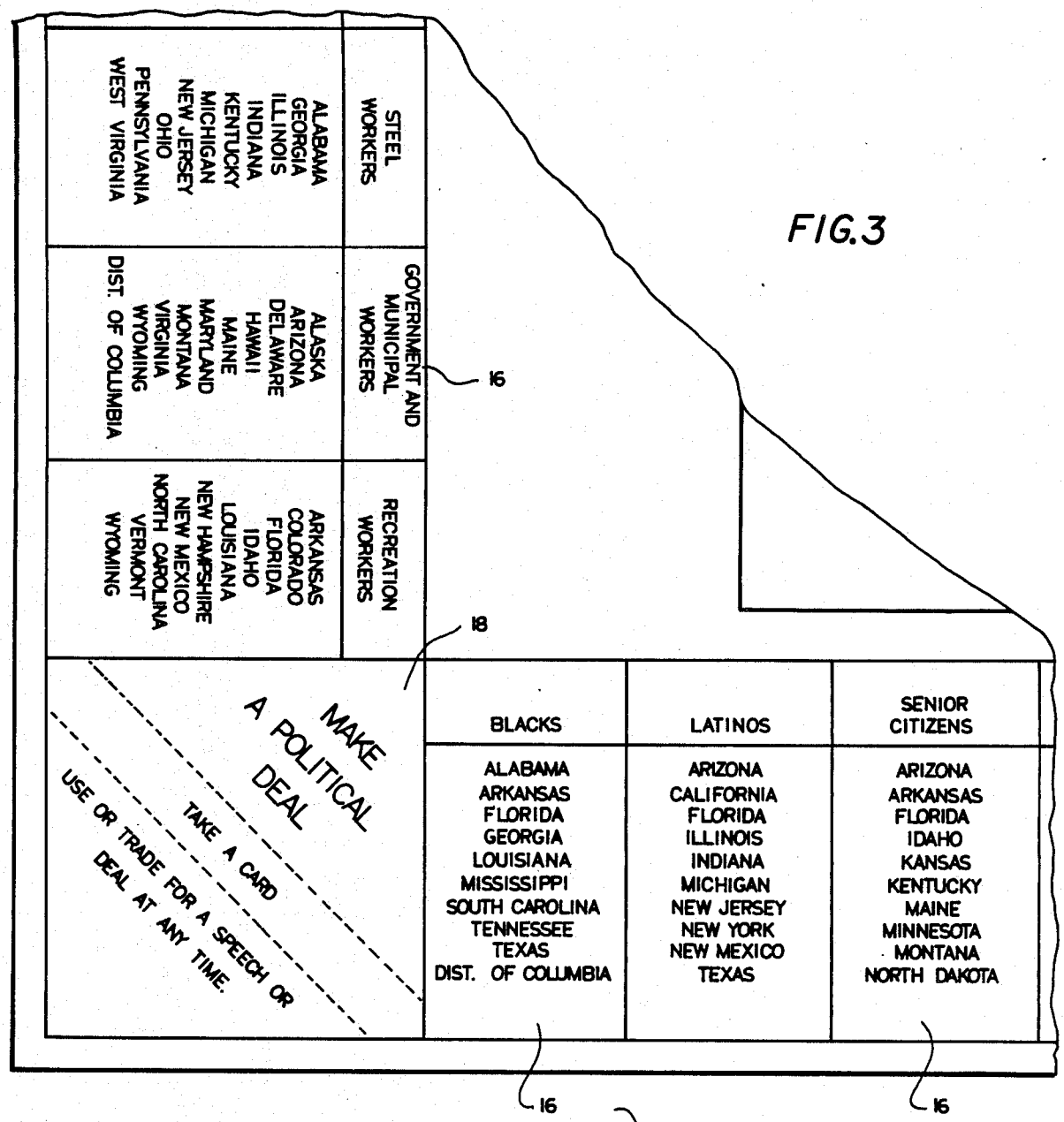
FIG. 3 is a top view, with portions broken away, showing in detail a number of the playing zones.
Figure 4:
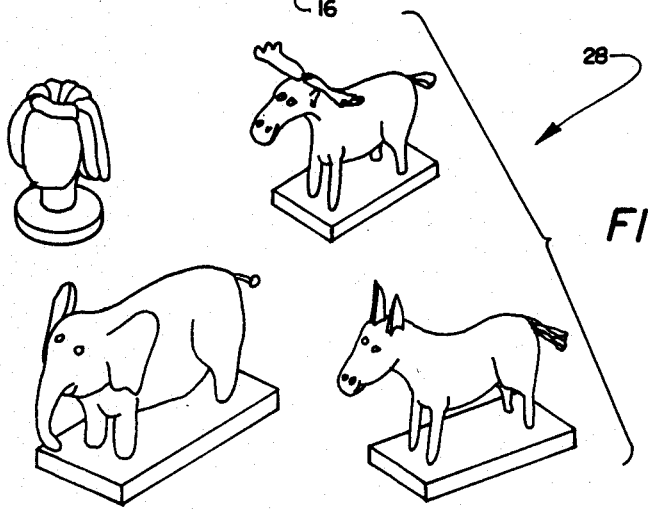
FIG. 4 is a perspective view of a plurality of player pieces.

As each player moves his piece, the piece will inevitably land on a popular vote obtaining zone 16 which, as shown in FIG. 3, have a particular voting group printed at one end thereof. Directly therebeneath a listing of states is provided. By landing on this zone the player is entitled to actuate his score registering means 42 and to designate an additional 5% of popular votes received in each state listed in the particular zone 16.

Likewise, when a player's piece 28 lands on a political occurrence zone 18, the player will be instructed to draw from a stack of like cards either a political speech card 22, political event card 24, or a political deal card 20. It is in these cards and their use that players may develop and use their political strategy and tactics. If a player lands on occurrence zone 18, which instructs drawing a speech card 22, the player may decline to draw or may use or trade the card if drawn. However, if open campaign is declared by the player, and this is done when the player makes a complete journey around the board 12 and lands on or passes the open campaign square, then the speech card 22 must immediately be used by the player.

If the player lands on an occurrence zone 18 which instructs the drawing of the political event card 24, the player must draw the card and follow its instructions immediately. As in actual elections political events are often unforeseen with the political ramifications unknown.

Finally, if a player lands on an occurrence zone 18 which instructs drawing a political deal card 20, the player must draw a card but can hold, trade or use it at any time during play of the game. This reflects a candidate's ability in an actual election to make a political deal at any time during an election campaign.

It should also be realized that on each of the cards as described above, and as particularly shown in FIGS. 5 through 7, the cards have listed thereon at least one column of states under the headings move forward or move back. For example, as as is illustrated in FIG. 7, should a player choose to exercise deal card 20 he would gain 5% of the popular vote in the states listed under move forward and lose 5% of the popular vote in the states similarly listed under move back. This loss or gain of popular votes is associated with all types of political occurrence cards. The preferred number of cards to be used is 44 for each type of political occurrence card. Some cards have move back and move forward categories while others may have a single category. However, it is to be realized that other totals can be used and are contemplated to be within the scope of the present invention.

Play ends when a particular player receives more than 50% of the popular votes in those states having an electoral college vote total greater than 270 votes. Upon receiving more than 50% of the popular vote in a given state, the player receives a state card 44 which provides historical and geographical information pertaining to that state and also discloses the number of electoral college votes which the player has won from that state. Should all state cards 44 be given to the players and no one has more than 270 electoral votes, then the player having the highest number of state cards is declared the winner. If the number of state cards is the same for two or more players then the player having the highest total of electoral college votes is declared the winner. Should this last method still produce a tie a flip of a coin between players will be the final determiner. It should, of course, be realized that the rules for determining the winner in the event of a tie in the present inventive game closely parallel the Constitution of the United States in that in event of an actual tie in the electoral vote process the election passes to the House of Representatives. Therefore, by playing this game, players obtain not only political astuteness but also gain an appreciation of the actual workings of the electoral college process.

From the foregoing, it is apparent that the objects of the present invention have been fully accomplished. As a result of the present invention a new and improved political electoral college campaign game has been disclosed. A preferred embodiment of the principles of this invention having been described and illustrated, it is to be realized that the same are not limited to the particular electoral college game configuration shown in the drawings, and that modifications thereof are contemplated and can be made without departing from the spirit and scope of this invention as defined in the appended claims.

What is claimed is:

1. A political campaign game for simulating the electoral college of the United States, comprising:

a game board having a playing surface defining a plurality of playing zones which establish a continuous path, one of said playing zones providing a starting position from which play is commenced, said playing zones including:

a first group of popular vote-obtaining zones each of which contains the names of a predetermined number of voting areas selected from fifty states and the District of Columbia, at least two of the zones of said first group containing the name of the same voting area; and a second group of political occurrence zones containing instructions for the drawing and using of cards;

a player scoring means for each player, each scoring means having a scoring surface with indicia indicating a candidate from a political party, a list of voting areas, and a score registering means for indicating the percentage of popular votes received in each voting area;

a plurality of distinct play pieces representing candidates from different political parties, each piece being selected and used by a player and moved along the continuous path;

a chance means for randomly determining the number of playing zones a play piece may be moved during a given player's turn;

a plurality of state cards, each of said cards having indicia setting forth the number of electoral votes available in that voting area, each of said state cards being presented to a player upon that player attaining 50 percent of the popular vote in that state; and a plurality of political occurrence cards containing instructions for controlling the actuation of said score registering means by a player, said political occurrence cards including:

cards which set forth a speech made by the player who draws that card and which causes popular votes to be gained or lost in predetermined voting areas;

cards setting forth events likely to occur during the course of a campaign, which cards instruct the player drawing a given card to gain or lose popular votes in predetermined voting areas; and cards which permit the player drawing a given one of the cards to enter into agreements with the other players regarding the gain or loss of votes in predetermined voting areas or the gain or loss of state cards.

2. The game of claim 1, wherein the score registering means adds or substracts votes in increments of 5 percent.

3. The game of claim 1, wherein 40 popular vote-obtaining zones are provided, each popular vote-obtaining zone containing the names of ten voting areas.

4. The game of claim 1, wherein 8 political occurrence zones are provided.

5. The game of claim 1, wherein the political occurrence cards dealing with speeches cause votes to be added or substracted in five predetermined voting areas.

6. The game of claim 1, wherein the political occurrence cards controlling political events cause votes to be added or substructed in five predetermined voting areas.

7. The game of claim 1, wherein the political occurrence cards dealing with political deals cause votes to be added in predetermined voting areas and simultaneously substracted in predetermined voting areas.

8. A political campaign game for simulating the electoral college of the United States, comprising:

a game board having a playing surface defining a plurality of playing zones which establish a continuous path, one of said playing zones providing a starting position from which play is commenced, said playing zones including:

a first group of 40 popular vote-obtaining zones each of which contains the names of ten voting areas selected from the fifty states and the District of Columbia, at least two of the zones of said first group containing the name of the same voting area; and a second group of eight political occurrence zones containing instructions for the drawing and using of cards;

a player scoring means for each player, each scoring means having a scoring surface with indicia indicating a candidate from a political party, a list of voting areas, and a score registering means for indicating gains or losses in increments of five percent of the popular votes received in each voting area;

a plurality of distinct play pieces representing candidates from different political parties, each piece being selected and used by a player and moved along the continuous path;

a chance means for randomly determining the number of playing zones a play piece may be moved during a given player's turn;

fifty-one state cards, each of said cards having indicia setting forth the number of electoral votes available in that voting area, said state cards being presented to a player upon that player attaining 50 percent of the popular vote in that state;

a plurality of political occurrence cards containing instructions for controlling the actuation of said score registering means by a player, said political occurrence cards including:

cards which set forth a speech made by the player who draws that card and which causes popular votes to be gained or lost in five predetermined voting areas;

cards setting forth events likely to occur during the course of a campaign, which cards instruct the player drawing a given card to gain or lose popular votes in five predetermined voting areas; and cards which permit the player drawing a given one of the cards to enter into agreements with the other players regarding the gain or loss of votes in predetermined voting areas or the gain or loss of state cards.

* * * * *